US006357782B1

(12) United States Patent
Pieber et al.

(10) Patent No.: US 6,357,782 B1
(45) Date of Patent: Mar. 19, 2002

(54) CROSS-COUNTRY SKI

(75) Inventors: Alois Pieber, Hohenzell; Johann Hubinger, Dorf, both of (AT)

(73) Assignee: Fischer Geserllschaft m.b.H., Ried im Innkreis (AT)

( * ) Notice: Subject to any disclaimer, the term of this patent is extended or adjusted under 35 U.S.C. 154(b) by 0 days.

(21) Appl. No.: 09/736,028

(22) PCT Filed: Jun. 22, 1999

(86) PCT No.: PCT/AT99/00163

§ 371 Date: Feb. 21, 2001

§ 102(e) Date: Feb. 21, 2001

(87) PCT Pub. No.: WO99/66994

PCT Pub. Date: Dec. 29, 1999

(30) Foreign Application Priority Data

Jun. 25, 1998 (AT) ..... 1105/98

(51) Int. Cl.[7] ..... A63C 5/048
(52) U.S. Cl. ..... 280/609; 280/601
(58) Field of Search ..... 280/609, 601, 280/604, 606, 608

(56) References Cited

U.S. PATENT DOCUMENTS

| | | | | | |
|---|---|---|---|---|---|
| 4,487,426 | A | | 12/1984 | Nishizawa | |
| 4,700,967 | A | * | 10/1987 | Meatto et al. | 280/609 |
| 4,756,544 | A | | 7/1988 | Abondance et al. | |
| 4,826,201 | A | * | 5/1989 | Varan et al. | 280/609 |
| 5,096,217 | A | * | 3/1992 | Hunter | 280/607 |
| 5,230,527 | A | * | 7/1993 | Varan | 280/609 |
| 5,427,400 | A | | 6/1995 | Bejean | |
| 6,079,746 | A | * | 6/2000 | Olsen | 280/809 |
| 6,241,272 | B1 | * | 6/2001 | Hammerle | 280/609 |

FOREIGN PATENT DOCUMENTS

| | | | | | |
|---|---|---|---|---|---|
| AT | 369273 | | | 12/1982 | |
| DE | 32 44 299 | | | 6/1983 | |
| EP | 0 253 660 | | | 1/1988 | |
| FR | 2 509 185 | | | 7/1981 | |
| FR | 2559673 | A1 | * | 2/1985 | A63C/5/04 |
| FR | 2643565 | A1 | * | 2/1989 | A63C/5/00 |
| WO | WO 93/22013 | A1 | * | 11/1993 | A63C/9/08 |

* cited by examiner

*Primary Examiner*—J. J. Swann
*Assistant Examiner*—J. Allen Shriver
(74) *Attorney, Agent, or Firm*—Jacobson Holman, PLLC

(57) ABSTRACT

To be able to utilize the kinetic energy which is due to the traveling speed of or the push-off energy inttroduced by the skier for a longer period than was possible with known skis, the invention provides for at least one of the lateral surfaces of the ski, notably the cross-country ski (SK), to be convex or parallel in the central area and concave in the front ans/or rear area.

16 Claims, 6 Drawing Sheets

CROSS-COUNTRY SKI

BACKGROUND OF THE INVENTION

Field of the Invention

The invention relates to a cross-country ski primarily designed for the skating technique.

It is an object of the invention to enable the skier, while running, to utilize for a longer time the kinetic energy arising from the running speed of the skier or from the impulsion energy introduced by the skier than has been possible so far with conventional skis, by a special configuration of the lateral shape or waisting of the ski.

In the skating technique, it is differentiated between two phases:

A—the impulsion phase

B—the sliding phase.

With the skating ski, impulsion is performed by a setting the edge of the ski SK via the edge of the running surface by a canting angle beta of between preferably 5 and 45° relative to the snow surface SCH, as is schematically illustrated in FIG. 1, and simultaneous b transverse positioning of the ski according to FIG. 2 at a certain excursion angle alpha, e.g. between 10 and 80°, depending on the inclination of the piste relative to the running direction, and c by introducing an impulsion impulse (depending on the running technique and the body weight of the skier).

For the sliding phase it is suitable if the sliding direction of the ski coincides with the running direction of the skier, as schematically illustrated in FIG. 3.

Arrow A indicates the running direction in FIGS. 2 and 3.

For an optimum utilization of the energy, it is suitable if the sliding phase, i.e. The phase in which the ski follows the running direction, is as long as possible, and the impulsion phase, i.e. that phase in which the ski must be set on edge and positioned transversely, can be kept as short as possible, cf. FIG. 4. There, lines GL and GR indicate the respective sliding phase of the left and right ski, respectively, and the respective subsequent curve AL and AR, respectively, indicate the impulsion phase of the left and right ski, respectively.

To enable the above-described and illustrated sequence of movement, a ski having different geometries of lateral shape would be required.

For a straight-line movement (sliding phase) or running along a straight line, a ski having straightline or concave lateral shape according to FIGS. 5 and 6, respectively, would be required.

For an outward movement of the ski (impulsion phase), convex lateral shapes according to FIG. 7 would be required.

The known ski either has a parallel waisting or a concave waisting, in which the ends of the ski and the tips of the ski are wider than the middle part of the ski. Moreover, in particular for the skating technique, skis are known which have a convex waisting in which the ski has a larger width in its middle part than in its front and rear regions. Finally, skis are known which have a convex or parallel waisting in a certain region and are arrow-shaped towards their tips. Skis having a concave waisting have properties causing the ski, when canted, i.e. when its edge is set, to follow its concave lateral shape, i.e. if this ski, e.g., is fastened to the right foot during a skating step, it will not pull outwards in relation to the running direction, but inwards. Skis having parallel lateral shapes behave relatively neutral, yet they substantially facilitate an outward movement as compared to a ski having a concave waisting. Skis having a convex lateral shape automatically favor an outward curve, in relation to the running direction.

When considering the skating technique on an ascending ground, for attaining an ascending effect, it will be desirable for the ski to pull outwardly from the running direction so as to obtain a certain transverse positioning in relation to the running direction so that the skier can push off on the outer ski and will be able to change into the other step. Convex or parallel lateral shapes are better for this technique than concave lateral shapes which have an opposite effect. The disadvantage of convex lateral shapes consists in that the ski, according to its waisting, will automatically pull into the curve as soon as it is set on edge. FIG. 8 serves to explain this behavior of the ski having a convex lateral shape, and in that Figure arrow A indicates the skiing direction. If the skier wants to pass the distance from X to Y with a conventional ski having convex lateral shape, the ski will automatically pull along its waisting into a curve designated by a as far as to an angle which will depend on the ascent of the track insofar as the higher the ascent of the track, the more the excursion from the skiing direction must be, in order to be able to effect an impulsion. The flatter the track, the less the excursion. With the known ski, the skier will have to break off his still remaining speed at the end of this excursion in disadvantageous manner so as not to drift too far away from the longitudinal direction. After the distance S from the starting point X onwards has been passed, the skier will change his step to his second foot which passes the distance S1 in analogous manner along curve a1.

From AT 369 273 a ski, preferably an Alpine ski, has been known which in its middle region does have a convex portion and, following thereupon, a concave portion. This cut-out of the lateral shape is to solve the problem of improving the behavior of the Alpine ski on particularly slippery, steep pistes.

SUMMARY OF THE INVENTION

It is the object of the invention to stabilize the longitudinal movement of the ski by a special design of its lateral shape, or of its waisting, respectively, so that the ski will not pull as much outwardly during its sliding phase and so that the speed still prevailing need not be stopped but much rather the kinetic energy will be utilized more efficiently and by an intended pressure increase and thus change of the pressure distribution on the area underneath the ski and the concentration of the weight on the middle region of the ski at the end of the sliding phase, the ski will be brought into its impulsion phase more rapidly, whereby the skier with an equal amount of impulsion energy introduced can pass through a flatter curve b, or b1, respectively, and thus can cover a distance W, or W1, respectively, which is longer than the distance S, or S1, respectively, covered by a conventional ski.

According to the invention, this object is achieved by having a middle region, of at least one of the two side faces of at least one ski of a pair of skis, designed to be convex or parallel, preferably to the central axis of the ski or in the sliding direction perpendicular to the track. The front and/or rear region of at least one side face of at least one ski of a pair of skis is designed to be concave so that the skier can push himself off on the outer ski and can alternate into the other step.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE INVENTION

Figure 1:
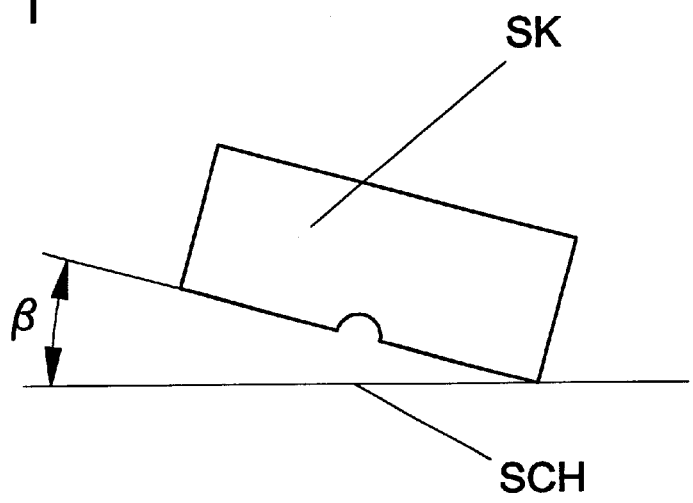
FIG. 1 illustrates a setting of an edge of a ski at a contrary angle relative to a snow surface.
Figure 2:
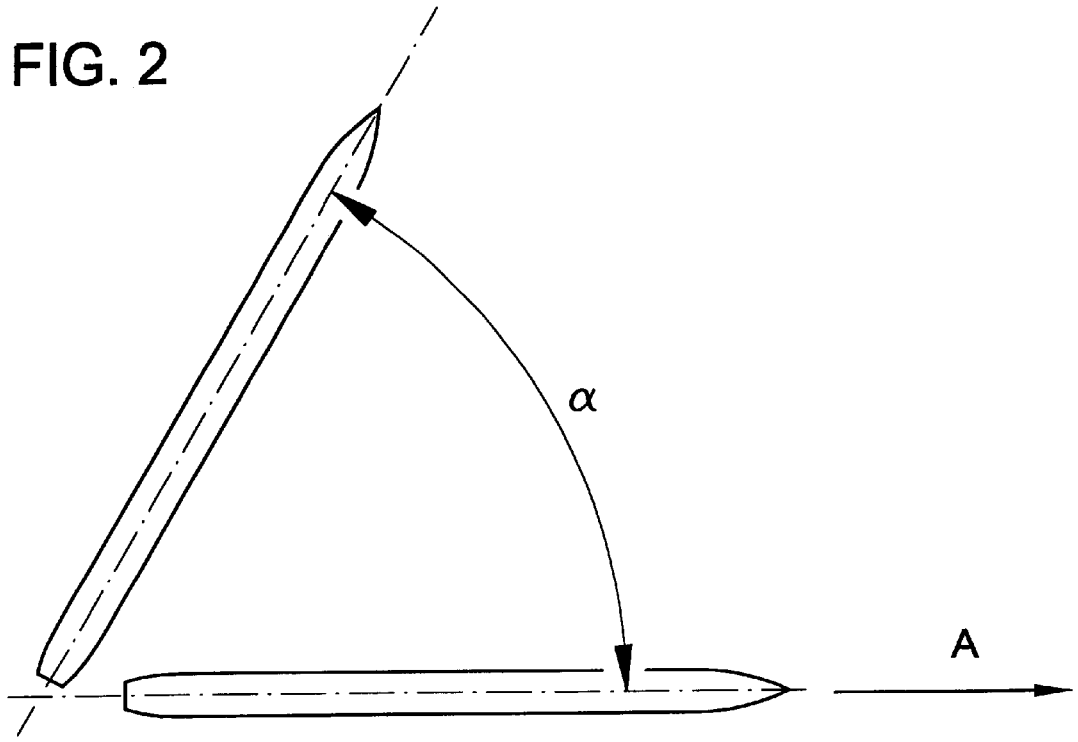
FIG. 2 illustrates a transverse positioning of a ski of an excursion angle.
Figure 3:
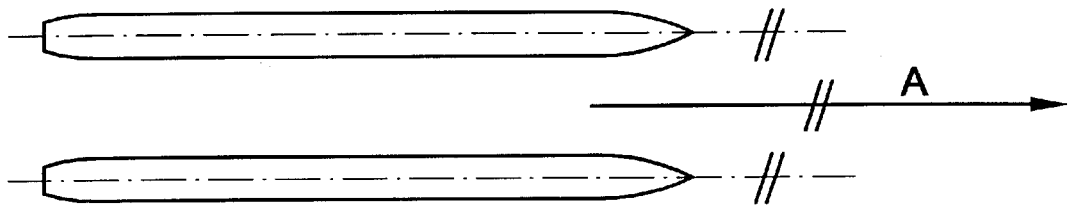
FIG. 3 illustrates a pair of skies with a sliding direction coinciding with a running direction.
Figure 4:
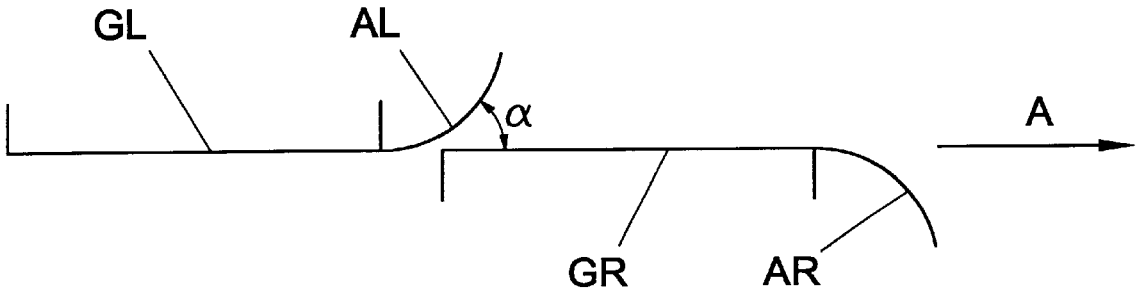
FIG. 4 illustrates respective sliding phases of the skis.
Figure 5:
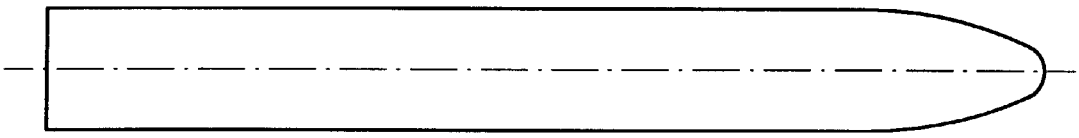
FIG. 5 illustrates the straight-line movement of a ski with a straight line shape.
Figure 6:
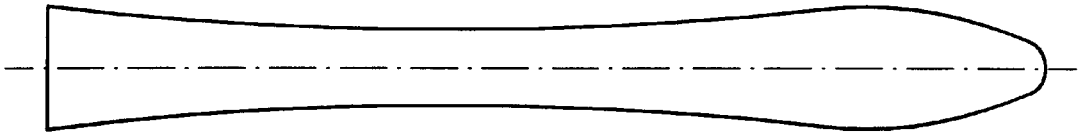
FIG. 6 illustrates the straight-line movement of a ski with a concave lateral slope.
Figure 7:
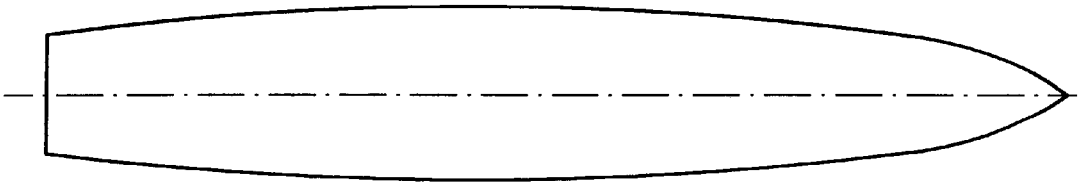
FIG. 7 illustrates a convex shaped ski and the straight-line movement.
Figure 8:
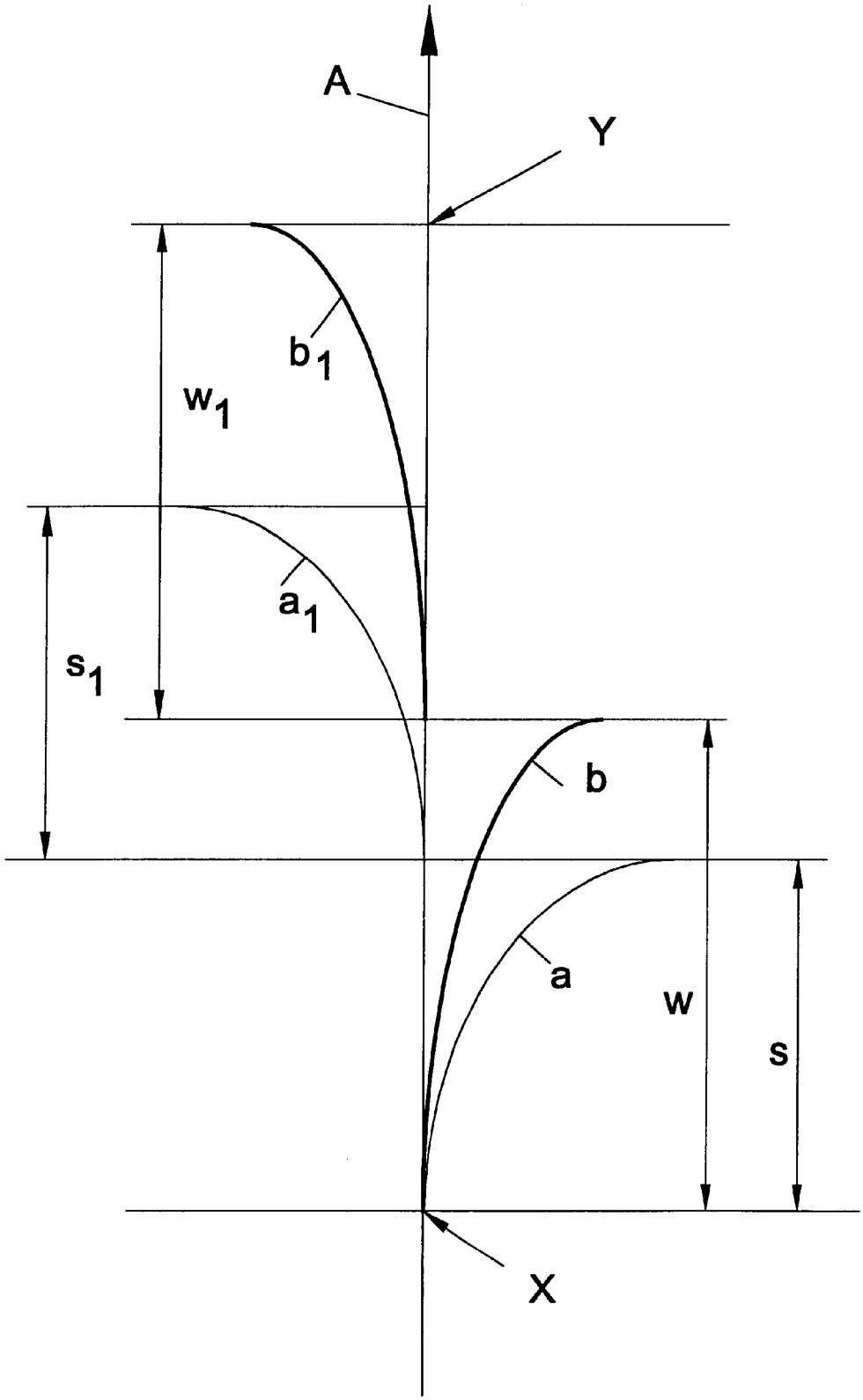
FIG. 8 illustrates a ski having a convex lateral shape.

Although only one preferred embodiment of the invention is explained in detail, it is to be understood that other embodiments are possible. Accordingly, it is not intended that the invention is to be limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Figure 10:
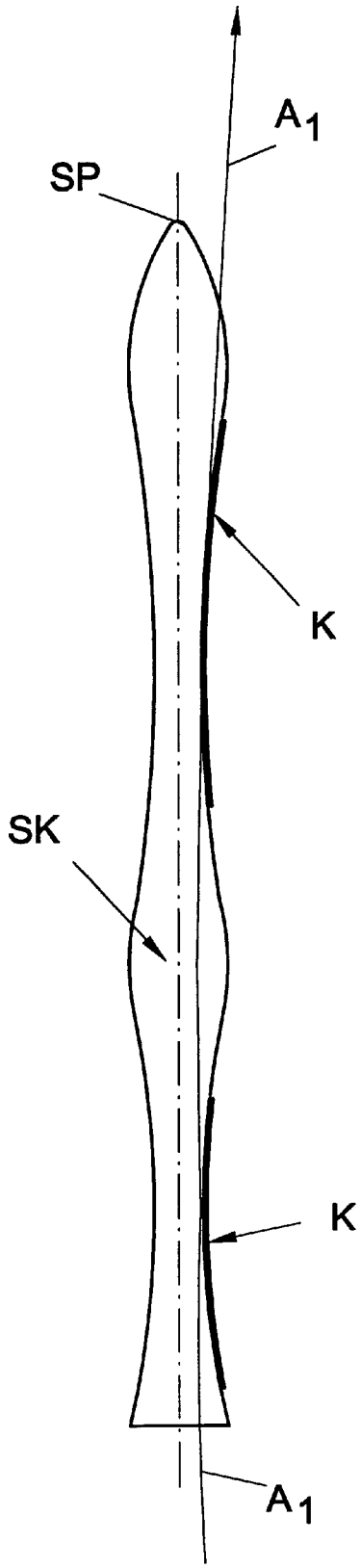
FIG. 10 illustrates the lines of contact when loaded as set forth in the present invention.
Figure 11:
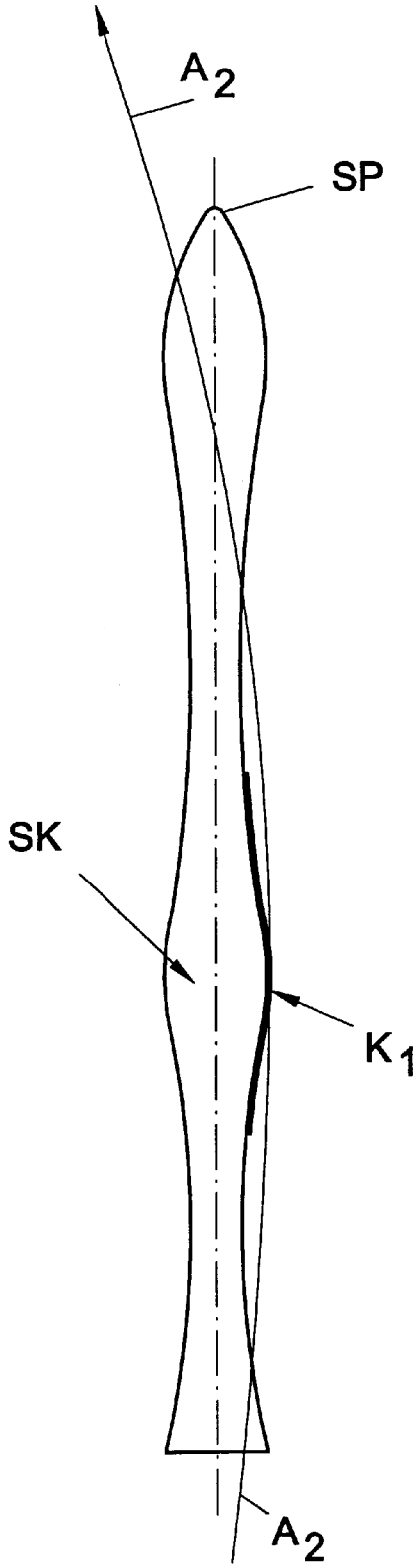
FIG. 11 illustrates the lines of contact when loaded and the running direction as in the present invention.

Further details of the invention will be explained by way of FIGS. 9 to 11 of the accompanying drawings. In the drawings mentioned, a ski is shown in top view in a simplified illustration.

The inventive combination of convex, concave portions best solves the basic problem of the invention if according to one feature of the invention, an enveloping curve or straight line in the shovel region is farther removed from the middle line of the ski than in the heel region thereof.

Figure 9:
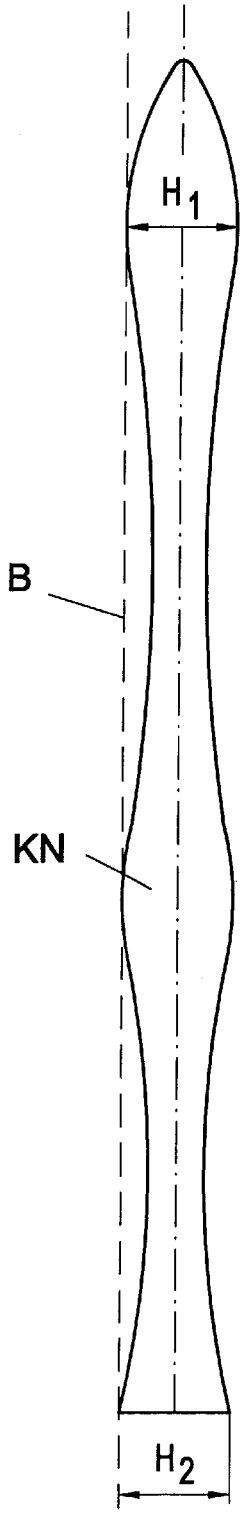
FIG. 9 illustrates a cross-country ski with a convex middle portion and ends as set forth in the present invention.
Figure 9A:
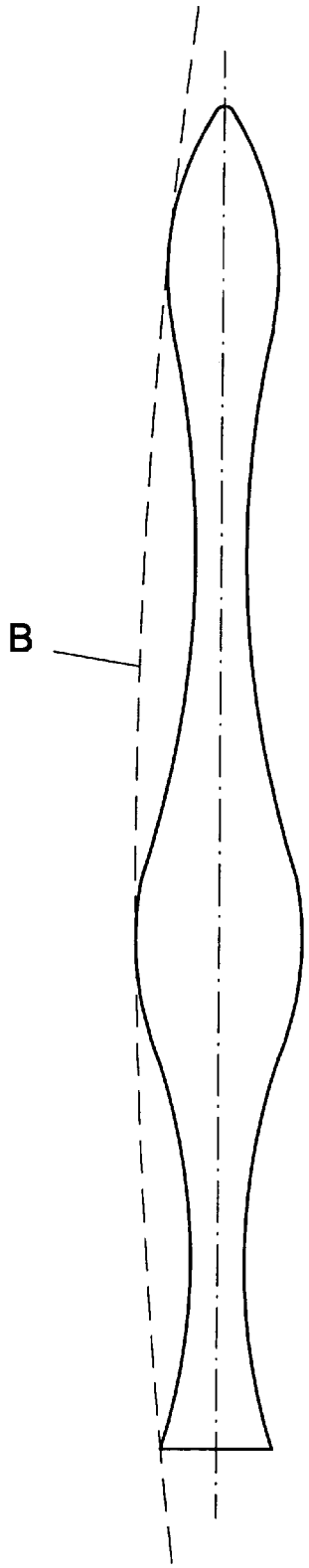
FIG. 9A illustrates the cross-country ski of the present invention with a convex arc at the tip, middle and heel of the ski.

In FIG. 9, a preferred embodiment of the lateral waisting of a cross-country ski is illustrated, whose convex portions, i.e. The convex middle portions KN as well as the widest portions H1 and H2 at the tip-side contacting edge, or heel-side contacting edge, respectively, contact an envelope designated by B and indicated in broken lines which, as is illustrated, may be a straight line or, as indicated in FIG. 9A, a convex arc. The envelope leads from the tip-side edge region H1 to the heel edge region H2 and contacts the vertex of the mean, convex portion KN.

With the ski SK of the invention whose ski tip is designated by SP, a utilization of two different directions of movement (straight-line or curved outwards) is enabled as follows, taking into consideration the course of stiffness and the associated distribution of pressure in the flat-lying ski underneath the running surface and in the canted ski at the running surface edge:

Sliding Phase

Since the middle portion of the skating ski (maximum load equals body weight of the skier) is not completely pressed onto the snow substrate during the sliding phase, merely those areas of the ski are responsible for the running direction of the ski which are H1 in contact with the snow substrate. The lines of contact when loaded, e.g. by half or the complete body weight, have been entered V in FIG. 10 in thickened lines and are denoted by K. If these contact surfaces of the sliding phase are combined with the optimum lateral shape of the sliding phase, there results a movement which is as straight as possible, which is denoted by arrow A1 in FIG. 10.

Impulsion Phase

During the impulsion phase, the pressure on the ski is increased and the edge of the ski is set, as illustrated in FIG. 1. Thereby the contact areas change to the middle portion of the ski. By arranging the convex or parallel lateral shapes in the middle region of the ski, the ski is moved outwards into the impulsion position. The line of contact when loaded, e.g., by the entire body weight up to 1½ times the body weight is entered in FIG. 11 in thick lines and denoted by K1, and the running direction of the ski is indicated by arrow A2.

What is decisive for this above-described sequence is the cooperation between the course of bending resistance, the lateral shape and the canting angle of the ski.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A pair of cross-country skis, each ski having longitudinal side faces, a tip-side contacting edge and a heel-side contacting edge, wherein a middle region of at least one of the two longitudinal side faces of at least one ski of the pair of skis is convex to a longitudinal axis of the ski, a front region between the middle region and the tip-side contacting edge and a rear region between the middle region and the heel-side contacting edge, at least one of said front and rear regions having a concave design, and the middle region and the widest parts at the tip-side contacting edge and on the heel-side contacting edge, respectively, contact a straight-line envelope.

2. A pair of cross-country skis, each ski having longitudinal side faces, a tip-side contacting edge and a heel-side contacting edge, wherein a middle region of at least one of the two longitudinal side faces of at least one ski of the pair of skis is parallel to a longitudinal axis of the ski, a front region between the middle region and the tip-side contacting edge and a rear region between the middle region and the heel-side contacting edge, at least one of said front and rear regions having a concave design, and the middle region and the widest parts at the tip-side contacting edge and on the heel-side contacting edge, respectively, contact a straight-line envelope.

3. The pair of skis according to claim 1 or 2, wherein the straight line envelope has a larger distance to the longitudinal axis of the ski at a site of contact of the tip-side contacting edge than in a region of the vertex of the middle region.

4. The pair of skis according to claim 1 or 2, wherein the middle region merges into the at least one region having a concave design without any edge.

5. The pair of skis according to claim 1 or 2, wherein the middle region extends over a region with a ski binding.

6. The pair of skis according to claim 1 or 2, wherein the middle region and the concave regions are arranged mirror-inverted relative to the longitudinal axis of the ski.

7. The pair of skis according to claim 1 or 2, wherein the middle and the concave regions on both ski and said pair of skis have the same shape.

8. A cross-country ski according to claim 1, characterized in that the convex or parallel and the concave regions are arranged mirror-inverted relative to the longitudinal center of the ski.

9. A cross-country ski according to claim 1, characterized in that the convex or parallel and the concave side face portions of both skis of a pair of ski have the same shape.

10. A pair of cross-country skis, each ski having longitudinal side faces, a tip-side contacting edge and a heel-side contacting edge, wherein a middle region of at least one of the two longitudinal side faces of at least one ski of the pair of skis is convex to a longitudinal axis of the ski, a front region between the middle region and the tip-side contacting edge and a rear region between the middle region and the heel-side contacting edge, at least one of said front and rear regions having a concave design, and the middle region and the widest parts at the tip-side contacting edge and on the heel-side contacting edge, respectively, contact a convex envelope.

11. A pair of cross-country skis, each ski having longitudinal side faces, a tip-side contacting edge and a heel-side contacting edge, wherein a middle region of at least one of the two longitudinal side faces of at least one ski of the pair of skis is parallel to a longitudinal axis of the ski, a front region between the middle region and the tip-side contacting edge and a rear region between the middle region and the heel-side contacting edge, at least one of said front and rear regions having a concave design, and the middle region and the widest parts at the tip-side contacting edge and on the heel-side contacting edge, respectively, contact a convex envelope.

12. The pair of skis according to claim 10 or 11, wherein the convex envelope has a larger distance to the longitudinal axis of the ski at a site of contact of the tip-side contacting edge than in a region of a vertex of the middle region.

13. The pair of skis according to claim 10 or 11, wherein the middle region merges into the at least one region having a concave design without any edge.

14. The pair of skis according to claim 10 or 11, wherein the middle region extends over a region with a ski binding.

15. The pair of skis according to claim 10 or 11, wherein the middle region and the concave regions are arranged mirror-inverted relative to the longitudinal axis of the ski.

16. The pair of skis according to claim 10 or 11, wherein the middle and the concave regions on both skis of said pair of skis have the same shape.

* * * * *